US006559106B1

(12) United States Patent
Nalesnik et al.

(10) Patent No.: US 6,559,106 B1
(45) Date of Patent: May 6, 2003

(54) TRI-GLYCERINATE VEGETABLE OIL-SUCCINHYDRAZIDE ADDITIVES FOR LUBRICANTS

(75) Inventors: Theodore E. Nalesnik, Hopewell Junction, NY (US); Franklin Barrows, Waterbury, CT (US)

(73) Assignee: Uniroyal Chemical Company, Inc., Middlebury, CT (US)

( * ) Notice: Subject to any disclaimer, the term of this patent is extended or adjusted under 35 U.S.C. 154(b) by 8 days.

(21) Appl. No.: 09/996,728

(22) Filed: Nov. 30, 2001

(51) Int. Cl.[7] ..... C10M 133/40
(52) U.S. Cl. ..... 508/255
(58) Field of Search ..... 508/255

(56) References Cited

U.S. PATENT DOCUMENTS

| | | | | |
|---|---|---|---|---|
| 3,284,234 | A | 11/1966 | Harvey et al. | 117/154 |
| 3,293,181 | A | 12/1966 | Stuart | 252/32.7 |
| 3,396,109 | A | 8/1968 | Butler et al. | 252/32.7 |
| 3,397,145 | A | 8/1968 | Cyba | 252/32.7 |
| 3,442,804 | A | 5/1969 | Suer et al. | 252/32.7 |
| 3,637,499 | A | 1/1972 | Pollak | 252/32.7 |
| 5,084,195 | A | 1/1992 | Camenzind et al. | 252/47.5 |
| 5,300,243 | A | 4/1994 | Camenzind et al. | 252/47.5 |
| 5,498,809 | A | 3/1996 | Emert et al. | 585/13 |
| 5,512,190 | A | 4/1996 | Anderson et al. | 252/47 |
| 5,514,189 | A | 5/1996 | Farng et al. | 44/383 |

FOREIGN PATENT DOCUMENTS

| | | |
|---|---|---|
| DE | 1260137 | 11/1965 |
| JP | 03140346 | 10/1989 |

*Primary Examiner*—Jerry D. Johnson
(74) *Attorney, Agent, or Firm*—Daniel Reitenbach

(57) ABSTRACT

Disclosed herein is a composition comprising:

(A) a lubricant, and (B) at least one compound of the formula:

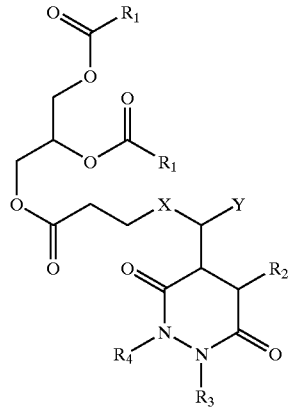

wherein:

each $R_1$ is an independently selected linear alkyl or alkenyl fatty acid group;

$R_2$ is a $C_1$ to $C_3$ alkyl group;

$R_3$ and $R_4$ are independently selected from the group consisting of hydrogen, alkyl, and aryl;

Y is a linear alkyl or alkenyl group; and

X is a linear or branched, saturated or unsaturated, divalent hydrocarbon group.

14 Claims, No Drawings

TRI-GLYCERINATE VEGETABLE OIL-SUCCINHYDRAZIDE ADDITIVES FOR LUBRICANTS

BACKGROUND OF THE INVENTION

1. Field of the Invention

This invention is related to lubricants, especially lubricating oils, and, more particularly, to a class of ashless and non-phosphorus, non-sulfur-containing anti-wear, anti-fatigue, extreme pressure, and anti-corrosion additives derived from tri-glycerinate vegetable oil-succinhydrazides.

2. Description of Related Art

In developing lubricating oils, there have been many attempts to provide additives that impart anti-fatigue, anti-wear, and extreme pressure properties thereto. Zinc dialkyldithiophosphates (ZDDP) have been used in formulated oils as anti-wear additives for more than fifty years. However, zinc dialkyldithiophosphates give rise to ash, which contributes to particulate matter in automotive exhaust emissions, and regulatory agencies are seeking to reduce emissions of zinc into the environment. In addition, phosphorus, also a component of ZDDP, is suspected of limiting the service life of the catalytic converters that are used on cars to reduce pollution. It is important to limit the particulate matter and pollution formed during engine use for toxicological and environmental reasons, but it is also important to maintain undiminished the anti-wear properties of the lubricating oil.

In view of the aforementioned shortcomings of the known zinc and phosphorus-containing additives, efforts have been made to provide lubricating oil additives that contain neither zinc nor phosphorus or, at least, contain them in substantially reduced amounts.

Illustrative of non-zinc, i.e., ashless, non-phosphorus-containing lubricating oil additives are the reaction products of 2,5-dimercapto-1,3,4-thiadiazoles and unsaturated mono-, di-, and tri-glycerides disclosed in U.S. Pat. No. 5,512,190 and the dialkyl dithiocarbamate-derived organic ethers of U.S. Pat. No. 5,514,189.

U.S. Pat. No. 5,512,190 discloses an additive that provides anti-wear properties to a lubricating oil. The additive is the reaction product of 2,5-dimercapto-1,3,4-thiadiazole and a mixture of unsaturated mono-, di-, and triglycerides. Also disclosed is a lubricating oil additive with anti-wear properties produced by reacting a mixture of unsaturated mono-, di-, and triglycerides with diethanolamine to provide an intermediate reaction product and reacting the intermediate reaction product with 2,5-dimercapto-1,3,4 thiadiazole.

U.S. Pat. No. 5,514,189 discloses that dialkyl dithiocarbamate-derived organic ethers have been found to be effective anti-wear/antioxidant additives for lubricants and fuels.

U.S. Pat. No. 3,284,234 discloses a stabilized cellulosic material which comprises a cellulosic material impregnated with at least 0.1 percent by weight of the cellulosic material of a hydrazide selected from the group consisting of the following compounds and mixtures thereof:

$$RCONHNH_2 \quad (I)$$

$$RCONHNHCOR \quad (II)$$

$$R'(CONHNH_2)_2 \quad (III)$$

wherein each R is independently selected from the group consisting of hydrogen and alkyl containing from 1 to 2 carbon atoms and wherein R' is selected from the group consisting of $(—CH_2—)_n$, wherein n is an integer having a value of 0 to 5 and an alkylene of 2 to 6 carbon atoms interrupted by from 1 to 2 atoms selected from the group consisting of oxygen and sulfur.

U.S. Pat. Nos. 5,084,195 and 5,300,243 disclose N-acyl-thiourethane thioureas as anti-wear additives specified for lubricants or hydraulic fluids.

German Patent 1,260,137 discloses ethylene polymers that are said to exhibit reduced film blocking that are prepared by adding fatty acid hydrazides with more than six carbon atoms in addition to the usual internal lubricants. Lauroyl hydrazide, palmitoyl hydrazide, and stearoyl hydrazide were specifically used.

Japanese Published Application No. 03140346 discloses rigid vinyl chloride resin compositions said to have improved processability comprising 100 parts vinyl chloride resins and 3–20 parts of compounds selected from $(R_1CONH)_2(CH_2)_n$ (wherein $R_1$ is an OH-substituted $C_1$–$C_{23}$ alkyl and n is 1–10), $(R_2CONH)_2(CH_2)_n$ (wherein $R_2$ is an OH-substituted $C_4$–$C_{23}$ alkyl and n is 1–10), $R_3CONHNH_2$ (wherein $R_3$ is an OH-substituted $C_4$–$C_{23}$ alkyl), $R_4NHCONHR_5$ (wherein $R_4$ is an OH-substituted alkyl, and $R_6NHCONH)_2R_7$ (wherein $R_6$ is an OH-substituted $C_7$–$C_{23}$ alkyl and $R_7$ is a $C_1$–$C_{10}$ alkylene, phenylene, or phenylene derivative). Stearic acid hydrazide and capric acid hydrazide are specifically mentioned.

U.S. application Ser. No. 09/871,120 filed May 31, 2001, discloses a composition comprising:

(A) a lubricant, and (B) at least one alkyl hydrazide compound of the formula:

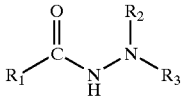

wherein $R_1$ is a hydrocarbon or functionalized hydrocarbon of from 1 to 30 carbon atoms, $R_2$ and $R_3$ are independently selected from the group consisting of hydrocarbon or functionalized hydrocarbons of from 1 to 30 carbon atoms and hydrogen.

The disclosures of the foregoing references are incorporated herein by reference in their entirety.

SUMMARY OF THE INVENTION

The present invention relates to a class of ashless, non-phosphorus, non-sulfur-containing anti-fatigue, anti-wear, and extreme pressure additives that can be used as either a partial or complete replacement for the zinc dialkyldithiophosphates that are currently used. These additives are of the structure:

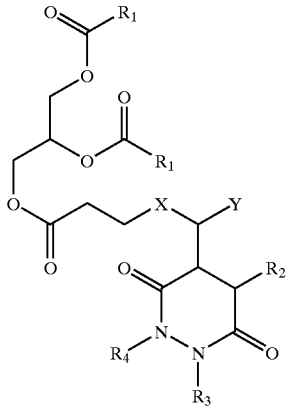

In the above structural formula, each $R_1$ is an independently selected linear alkyl or alkenyl fatty acid group of the kind typically found in vegetable oils comprising from about 8 to about 22 carbon atoms. $R_2$ can be a $C_1$ to $C_3$ alkyl group, such as methyl, ethyl, propyl, or isopropyl. Y can be a linear alkyl or alkenyl group, preferably of from about 5 to about 12 carbon atoms, and X can be a linear or branched, saturated or unsaturated, divalent hydrocarbon group, preferably of from about 5 to about 13 carbon atoms. $R_3$ and $R_4$ can independently be the same or different and can be hydrogen, alkyl, or aryl. The fatty acid group derivatized with succinhydrazide functionality can be either alpha or beta in the triglycerinate oil or both.

More particularly, the present invention is directed to a composition comprising:

(A) a lubricant, and (B) at least one compound of the formula:

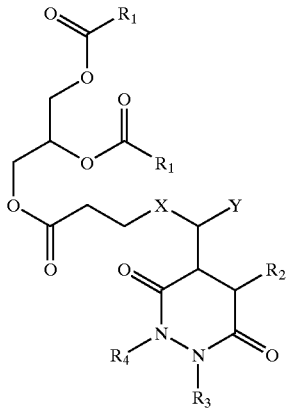

wherein:

each $R_1$ is an independently selected linear alkyl or alkenyl fatty acid group;

$R_2$ is a $C_1$ to $C_3$ alkyl group;

$R_3$ and $R_4$ are independently selected from the group consisting of hydrogen, alkyl, and aryl;

Y is a linear alkyl or alkenyl group; and

X is a linear or branched, saturated or unsaturated, divalent hydrocarbon group.

Preferably, the tri-glycerinate vegetable oil-succinhydrazide is present in the compositions of the present invention in a concentration in the range of from about 0.01 to about 10 wt %.

DESCRIPTION OF THE PREFERRED EMBODIMENTS

The additives of the present invention are compounds of the formula:

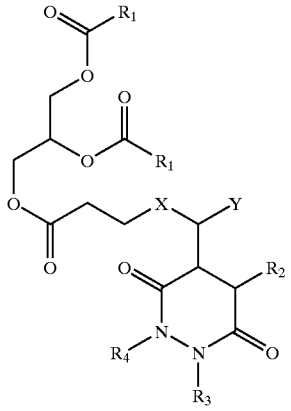

In the above structural formula, each $R_1$ is an independently selected linear alkyl or alkenyl fatty acid group of the kind typically found in vegetable oils comprising from about 8 to about 22 carbon atoms. $R_2$ can be a $C_1$ to $C_3$ alkyl group, such as methyl, ethyl, propyl, or isopropyl. Y can be a linear alkyl or alkenyl group, preferably of from about 5 to about 12 carbon atoms, and X can be a linear or branched, saturated or unsaturated, divalent hydrocarbon group, preferably of from about 5 to about 13 carbon atoms. $R_3$ and $R_4$ can independently be the same or different and can be hydrogen, alkyl, or aryl. Preferably, where $R_3$ and/or $R_4$ are other than hydrogen, they comprise from 1 to 10 carbon atoms. The fatty acid group derivatized with succinhydrazide functionality can be either alpha or beta in the triglycerinate oil or both.

In the above structural formula, $R_1$ can, for example, be octyl, nonyl, decyl, undecyl, dodecyl, tridecyl, tetradecyl, pentadecyl, hexadecyl, heptadecyl, octadecyl, oleyl, nonadecyl, eicosyl, heneicosyl, docosyl, octenyl, nonenyl, decenyl, undecenyl, dodecenyl, tridecenyl, tetradecenyl, pentadecenyl, hexadecenyl, heptadecenyl, octadecenyl, oleyl, nonadecenyl, eicosenyl, heneicosenyl, docosenyl, and the like, and mixtures thereof Y can, for example, be pentyl, hexyl, octyl, nonyl, decyl, undecyl, dodecyl, pentenyl, hexenyl, octenyl, nonenyl, decenyl, undecenyl, dodecenyl, and the like, and mixtures thereof The use of the compounds of this invention can improve the anti-fatigue, anti-wear, and extreme pressure properties of a lubricant.

General Synthesis of Additives of this Invention

In another aspect, the present invention is directed to a process for preparing the triglycerinate vegetable oil-succinhydrazides. The process used to make this material produces a lighter and more oil-soluble product in mineral and fully formulated motor oils. To produce a product of lower color darkness, the intermediate vegetable oil succinic anhydride is prepared through the thermal "ene" reaction of maleic anhydride reacted with an unsaturated vegetable oil at temperatures of less than 210° C. rather than at temperatures above 220° C. This intermediate is then reacted with the hydrazine, neat or in a hydrocarbon solvent, to produce the final product. When derivatizing succinic anhydride functions with mono or unsymmetrical hydrazines, a minor by-product form may be the succinimide hydrazide (i.e., a 5-membered ring). It is also believed this by-product may also exhibit anti-wear properties.

It was found that the solubility of the product in mineral and fully formulated oils, as observed by the haze intensity in blended oils at one weight percent, was markedly reduced by: (1) using high mono-unsaturated oils, such as rapeseed and canola oils and avoiding highly polyunsaturated oils, such as safflower and corn oils and (2) by preparing the vegetable oil intermediate succinic anhydride with molar ratios of vegetable oil to maleic anhydride of 1:<0.80, respectively.

Preparation of Maleated Canola Oil

In a 250 mL flask, equipped with a mechanical stirrer, nitrogen blanket, thermocouple, and heating mantle, is charged 88.5 grams (0.1 mole) of canola oil and 5.9 grams (0.60 mole) of maleic anhydride. Under a nitrogen atmosphere and stirring, the reaction media are heated to 200° C. for ten hours. After ten hours at 200° C., the reaction product is placed under 15 mm pressure,(vacuum) to remove unreacted maleic anhydride. The product is 94.1 grams of a fluid, brownish yellow, liquid.

Preparation of Canola Oil Succinhydrazide

In a 250 mL flask, equipped with a mechanical stirrer, nitrogen blanket, Dean-Stark water trap, thermocouple, and heating mantle, is charged 47.2 grams (0.05 mole) of the above maleated canola oil and 75 mL of hexane. To this stirring solution is added 1.5 grams (0.03 mole) of hydrazine hydrate and the temperature is raised to 60° C. and held there for 30 minutes. The reaction media is then heated to a vigorous reflux to remove the water by-product as an azeotrope with hexane to the Dean-Stark trap. The hexane solvent is then removed under vacuum to give 47.3 grams of final product. Infrared analysis shows conversion of the succinic anhydride group to the succinhydrazide functionality.

Use with Other Additives

The tri-glycerinate vegetable oil-succinhydrazide additives of the present invention can be used as either a partial or complete replacement for the zinc dialkyldithiophosphates currently used. They can also be used in combination with other additives typically found in lubricating oils, as well as with other ashless, anti-wear additives. These compounds may also display synergistic effects with these other typical additives to improve oil performance properties. The additives typically found in lubricating oils are, for example, dispersants, detergents, corrosion/rust inhibitors, antioxidants, anti-wear agents, anti-foamants, friction modifiers, seal swell agents, demulsifiers, VI improvers, pour point depressants, and the like. See, for example, U.S. Pat. No. 5,498,809 for a description of useful lubricating oil composition additives, the disclosure of which is incorporated herein by reference in its entirety. Examples of dispersants include polyisobutylene succinimides, polyisobutylene succinate esters, Mannich Base ashless dispersants, and the like. Examples of detergents include alkyl metallic phenates, alkyl metallic sulfirized phenates, alkyl metallic sulfonates, alkyl metallic salicylates, and the like. Examples of antioxidants include alkylated diphenylamines, N-alkylated phenylenediamines, hindered phenolics, alkylated hydroquinones, hydroxylated thiodiphenyl ethers, alkylidenebisphenols, oil soluble copper compounds, and the like. Examples of anti-wear additives that can be used in combination with the additives of the present invention include organo borates, organo phosphites, organic sulfur-containing compounds, zinc dialkyldithiophosphates, zinc diaryldithiophosphates, phosphosulfurized hydrocarbons, and the like. The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others. Examples of friction modifiers include fatty acid esters and amides, organo sulfurized and unsulfurized molybdenum compounds, molybdenum dialkylthiocarbamates, molybdenum dialkyl dithiophosphates, and the like. An example of an anti-foamant is polysiloxane, and the like. An example of a rust inhibitor is a polyoxyalkylene polyol, and the like. Examples of VI improvers include olefin copolymers and dispersant olefin copolymers, and the like. An example of a pour point depressant is polymethacrylate, and the like.

Representative conventional anti-wear agents that can be used include, for example, the zinc dialkyl dithiophosphates and the zinc diaryl dithiophosphates.

Suitable phosphates include dihydrocarbyl dithiophosphates, wherein the hydrocarbyl groups contain an average of at least 3 carbon atoms. Particularly useful are metal salts of at least one dihydrocarbyl dithiophosphoric acid wherein the hydrocarbyl groups contain an average of at least 3 carbon atoms. The acids from which the dihydrocarbyl dithiophosphates can be derived can be illustrated by acids of the formula:

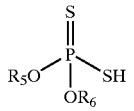

wherein $R_5$ and $R_6$ are the same or different and are alkyl, cycloalkyl, aralkyl, alkaryl or substituted substantially hydrocarbon radical derivatives of any of the above groups, and wherein the $R_5$ and $R_6$ groups in the acid each have, on average, at least 3 carbon atoms. By "substantially hydrocarbon" is meant radicals containing substituent groups (e.g., 1 to 4 substituent groups per radical moiety) such as ether, ester, nitro, or halogen that do not materially affect the hydrocarbon character of the radical.

Specific examples of suitable $R_5$ and $R_6$ radicals include isopropyl, isobutyl, n-butyl, sec-butyl, n-hexyl, heptyl, 2-ethylhexyl, diisobutyl, isooctyl, decyl, dodecyl, tetradecyl, hexadecyl, octadecyl, butylphenyl,o,p-depentylphenyl, octylphenyl, polyisobutene-(molecular weight 350)-substituted phenyl, tetrapropylene-substituted phenyl, beta-octylbutylnaphthyl, cyclopentyl, cyclohexyl, phenyl, chlorophenyl, o-dichlorophenyl, bromophenyl, naphthenyl, 2-methylcyclohexyl, benzyl, chlorobenzyl, chloropentyl, dichlorophenyl, nitrophenyl, dichlorodecyl and xenyl radicals. Alkyl radicals having from about 3 to about 30 carbon atoms and aryl radicals having from about 6 to about 30 carbon atoms are preferred. Particularly preferred $R_5$ and $R_6$ radicals are alkyl of from 4 to 18 carbon atoms.

The phosphorodithioic acids are readily obtainable by the reaction of phosphorus pentasulfide and an alcohol or phenol. The reaction involves mixing, at a temperature of about 20° C. to 200° C., 4 moles of the alcohol or phenol with one mole of phosphorus pentasulfide. Hydrogen sulfide is liberated as the reaction takes place. Mixtures of alcohols, phenols, or both can be employed, e.g., mixtures of $C_3$ to $C_{30}$ alcohols, $C_6$ to $C_{30}$ aromatic alcohols, etc.

The metals useful to make the phosphate salts include Group I metals, Group II metals, aluminum, lead, tin, molybdenum, manganese, cobalt, and nickel. Zinc is the preferred metal. Examples of metal compounds that can be reacted with the acid include lithium oxide, lithium hydroxide, lithium carbonate, lithium pentylate, sodium oxide, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide, and nickel carbonate.

In some instances, the incorporation of certain ingredients, particularly carboxylic acids or metal carboxylates, such as, small amounts of the metal acetate or acetic acid, used in conjunction with the metal reactant will facilitate the reaction and result in an improved product. For example, the use of up to about 5% of zinc acetate in combination with the required amount of zinc oxide facilitates the formation of a zinc phosphorodithioate.

The preparation of metal phosphorodithioates is well known in the art and is described in a large number of issued patents, including U.S. Pat. Nos. 3,293,181; 3,397,145; 3,396,109 and 3,442,804, the disclosures of which are hereby incorporated by reference. Also useful as anti-wear additives are amine derivatives of dithiophosphoric acid compounds, such as are described in U.S. Pat. No. 3,637,499, the disclosure of which is hereby incorporated by reference in its entirety.

The zinc salts are most commonly used as antiwear additives in lubricating oil in amounts of 0.1 to 10, preferably 0.2 to 2, wt. %, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols can be used, including mixtures of primary and secondary alcohols, secondary generally for imparting improved anti-wear properties and primary for thermal stability. Mixtures of the two are particularly useful. In general, any basic or neutral zinc compound could be used, but the oxides, hydroxides, and carbonates are most generally employed. Commercial additives frequently contain an excess of zinc owing to use of an excess of the basic zinc compound in the neutralization reaction.

The zinc dihydrocarbyl dithiophosphates (ZDDP) are oil soluble salts of dihydrocarbyl esters of dithiophosphoric acids and can be represented by the following formula:

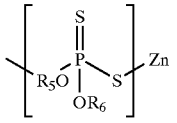

wherein $R_5$ and $R_6$ are as described in connection with the previous formula.

Especially preferred additives for use in the practice of the present invention include alkylated diphenylamines, hindered alkylated phenols, hindered alkylated phenolic esters, and molybdenum dithiocarbamates.

Lubricant Compositions

Compositions, when they contain these additives, are typically blended into the base oil in amounts such that the additives therein are effective to provide their normal attendant functions. Representative effective amounts of such additives are illustrated in TABLE 1.

TABLE 1

| Additives | Preferred Weight % | More Preferred Weight % |
|---|---|---|
| V.I. Improver | 1–12 | 1–4 |
| Corrosion Inhibitor | 0.01–3 | 0.01–1.5 |
| Oxidation Inhibitor | 0.01–5 | 0.01–1.5 |
| Dispersant | 0.01–10 | 0.01–5 |
| Lube Oil Flow Improver | 0.01–2 | 0.01–1.5 |
| Detergent/Rust Inhibitor | 0.01–6 | 0.01–3 |
| Pour Point Depressant | 0.01–1.5 | 0.01–0.5 |
| Antifoaming Agent | 0.001–0.1 | 0.001–0.01 |
| Antiwear Agent | 0.001–5 | 0.001–1.5 |
| Seal Swellant | 0.1–8 | 01.–4 |
| Friction Modifier | 0.01–3 | 0.01–1.5 |
| Lubricating Base Oil | Balance | Balance |

When other additives are employed, it may be desirable, although not necessary, to prepare additive concentrates comprising concentrated solutions or dispersions of the subject additives of this invention, together with one or more of said other additives (said concentrate when constituting an additive mixture.being referred to herein as an additive-package) whereby several additives can be added simultaneously to the base oil to form the lubricating oil composition. Dissolution of the additive concentrate into the lubricating oil can be facilitated by solvents and/or by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the lubricant compositions of the invention contain the additives in a concentration ranging from about 0.05 to about 30 weight percent. A concentration range for the additives ranging from about 0.1 to about 10 weight percent based on the total weight of the oil composition is preferred. A more preferred concentration range is from about 0.2 to about 5 weight percent. Oil concentrates of the additives can contain from about 1 to about 75 weight percent of the additive reaction product in a carrier or diluent oil of lubricating oil viscosity.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof. Suitable lubricating oil base stocks include base stocks obtained by isomerization of synthetic wax and wax, as well as hydrocrackate base stocks produced by hydrocracking (rather than solvent extracting) the aromatic and polar components of the crude. Natural lubricating oils include animal oils, such as, lard oil, vegetable oils (e.g., canola oils, castor oils, sunflower oils), petroleum oils, mineral oils, and oils derived from coal or shale.

Synthetic oils include hydrocarbon oils and halo-substituted hydrocarbon oils, such as, polymerized and interpolymerized olefins, alkylbenzenes, polyphenyls, alkylated diphenyl ethers, alkylated diphenyl sulfides, as well as their derivatives, analogs, homologues, and the like. Synthetic lubricating oils also include alkylene oxide polymers, interpolymers, copolymers, and derivatives thereof, wherein the terminal hydroxyl groups have been modified by esterification, etherification, etc.

Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyalkyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, poly α-olefins, and the like.

The lubricating oil may be derived from unrefined, refined, rerefined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a VI of at least 130, preferably at least 135 or higher and, following dewaxing, a pour point of about −20° C. or lower.

The additives of the present invention are especially useful as components in many different lubricating oil compositions. The additives can be included in a variety of oils with lubricating viscosity, including natural and synthetic lubricating oils and mixtures thereof The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

The advantages and the important features of the present invention will be more apparent from the following examples.

EXAMPLES

Four-Ball AntiWear Testing

The antiwear properties of the tri-glycerinate vegetable oil-succinhydrazides of the present invention at a level of 1.0 wt % in a fully formulated SAE 5W-20 GF-3 motor oil formulation were determined in the Four-Ball Wear Test under the ASTM D 4172 test conditions. The fully formulated lubricating oils tested also contained 1 weight percent cumene hydroperoxide to help simulate the environment within a running engine. The additives were tested for effectiveness in a motor oil formulation (See description in Table 2) and compared to identical formulations with and without any zinc dialkyldithiophosphate. In Table 3, the numerical value of the test results (Average Wear Scar Diameter, mm) decreases with an increase in effectiveness.

TABLE 2

SAE 5W-20 Prototype Motor Oil Formulations

| Component | Formulation A (wt %) |
|---|---|
| Solvent Neutral 100 | 22.8 |
| Solvent Neutral 150 | 60 |
| Succinimide Dispersant | 7.5 |
| Overbased Calcium Phenate Detergent | 2.0 |
| Neutral Calcium Sulfonate Detergent | 0.5 |
| Rust Inhibitor | 0.1 |
| Antioxidant | 0.5 |
| Pour Point Depressant | 0.1 |
| OCP VI Improver | 5.5 |
| Anti-wear Additive[1] | 1.0 |

[1]In the case of No anti-wear additive in Table 2, solvent neutral 100 is put in its place at 1.0 weight percent.

TABLE 3

Four-Ball Wear Results

| Compound | Formulation | Wear Scar Diameter, mm |
|---|---|---|
| No anti-wear additive | A | 0.73 (0.74)** |
| 1.0 weight % Zinc dialkyldithiophosphate | A | 0.50 (0.51) |
| 0.5 weight % Zinc dialkyldithiophosphate | A | 0.70 (0.67) |
| Olive Oil/Hydrazide | A | 0.40 (0.40) |
| Safflower Oil/Hydrazide | A | 0.36 (0.40) |
| Safflower Oil/N-Methyl Hydrazide | A | 0.39 (0.39) |
| Corn Oil/Hydrazide | A | 0.39 (0.39) |
| Peanut Oil/Hydrazide | A | 0.35 (0.47) |
| Canola Oil/Hydrazide | A | 0.60 |
| Peanut Oil/Succinic Anydride* | A | 0.97 (0.91) |

*An intermediate, not a hydrazide
**The numbers in parentheses are repeated test results.

Cameron-Plint TE77 High Frequency Friction Machine Anti-wear Testing

Another test used to determine the anti-wear properties of these products is the Cameron-Plint Anti-wear test based on a sliding ball on a plate. The specimen parts (6 mm diameter AISI 52100 steel ball of 800±20 kg/mm$^2$ hardness and hardened ground NSOH B01 gauge plate of RC 60/0.4 micron) are rinsed and then sonicated for 15 minutes with technical grade hexanes. This procedure is repeated with isopropyl alcohol. The specimens are dried with nitrogen and set into the TE77. The oil bath is filled with 10 mL of sample. The test is run at a 30 Hertz Frequency, 100 Newton Load, 2.35 mm Amplitude. The test starts with the specimens and oil at room temperature. Immediately, the temperature is ramped over 15 minutes to 50° C., where it dwells for 15 minutes. The temperature is then ramped over 15 minutes to 100° C., where it dwells for 45 minutes. A third temperature ramp over 15 minutes to 150° C. is followed by a final dwell at 150° C. for 15 minutes. The total length of the test is 2 hours. At the end of the test, the wear scar diameter on the 6 mm ball is measured using a Leica StereoZoom® Stereomicroscope and a Mitutoyo 164 series Digimatic Head.

In the Examples below, the filly formulated lubricating oils tested contained 1 wt. % cumene hydroperoxide to help simulate the environment within a running engine. The test additive was blended at 1.0 wt. % in a fully formulated SAE 5W-20 Prototype GF-4 Motor Oil formulation containing no ZDDP. The additives were tested for effectiveness in this motor oil formulation (See description in Table 4) and compared to identical formulations with and without any zinc dialkyldithiophosphate. In Table 4 the numerical value of the test results (Ball Wear Scar Diameter, Plate Scar Width, and Plate Scar Depth) decreases with an increase in effectiveness.

TABLE 4

Cameron-Plint Wear Test

| Additive at 1.0 Weight Percent | Ball Scar (mm) | Plate Scar Width (mm) | Plate Scar Depth (μm) |
|---|---|---|---|
| Olive Oil/Hydrazide | 0.62 (0.59) | 0.57 (0.48) | 9.6 (9.9) |
| Canola Oil/Hydrazide | 0.56 (0.68) | 0.8 (0.8) | 5.2 (10.1) |

TABLE 4-continued

Cameron-Plint Wear Test

| Additive at 1.0 Weight Percent | Ball Scar (mm) | Plate Scar Width (mm) | Plate Scar Depth (μm) |
|---|---|---|---|
| No anti-wear additive[1] | 0.66 | 0.74 | 15.05 |
| Zinc dialkyldithiophosphate (1.0 wt %) | 0.39 | 0.72 | 1.83 |
| Zinc dialkyldithiophosphate (0.5 wt %) | 0.62 | 0.76 | 14.77 |

*Numbers in parentheses are repeat test results.
[1]In the case of No anti-wear additive in Table 4, solvent neutral 100 is put in its place at 1.0 weight percent.

In view of the many changes and modifications that can be made without departing from principles underlying the invention, reference should be made to the appended claims for an understanding of the scope of the protection to be afforded the invention.

What is claimed is:

1. A composition comprising:

(A) a lubricant, and (B) at least one compound of the formula:

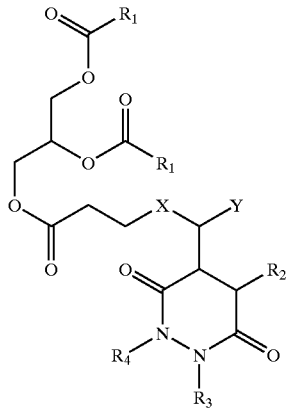

wherein:

each $R_1$ is an independently selected linear alkyl or alkenyl fatty acid group;

$R_2$ is a $C_1$ to $C_3$ alkyl group;

$R_3$ and $R_4$ are independently selected from the group consisting of hydrogen, alkyl, and aryl;

Y is a linear alkyl or alkenyl group; and

X is a linear or branched, saturated or unsaturated, divalent hydrocarbon group.

2. The composition of claim 1 wherein the lubricant is a lubricating oil.

3. The composition of claim 1 wherein each $R_1$ is an independently selected linear alkyl or alkenyl fatty acid group of from about 8 to about 22 carbon atoms.

4. The composition of claim 2 wherein each $R_1$ is an independently selected linear alkyl or alkenyl fatty acid group of from about 8 to about 22 carbon atoms.

5. The composition of claim 1 wherein Y is a linear alkyl or alkenyl group of from about 5 to about 12 carbon atoms.

6. The composition of claim 2 wherein Y is a linear alkyl or alkenyl group of from about 5 to about 12 carbon atoms.

7. The composition of claim 1 wherein X is a linear or branched, saturated or unsaturated, divalent hydrocarbon group of from about 5 to about 13 carbon atoms.

8. The composition of claim 2 wherein X is a linear or branched, saturated or unsaturated, divalent hydrocarbon group of from about 5 to about 13 carbon atoms.

9. The composition of claim 1 wherein the compound is present in a concentration in the range offrom about 0.01 to about 10 wt %.

10. The composition of claim 2 wherein the compound is present in a concentration in the range of from about 0.01 to about 10 wt %.

11. The composition of claim 1 further comprising at least one additive selected from the group consisting of dispersants, detergents, corrosion/rust inhibitors, zinc dialkyldithiophosphates, VI improvers, pour point depressants, antioxidants, and friction modifiers.

12. The composition of claim 2 further comprising at least one additive selected from the group consisting of dispersants, detergents, corrosion/rust inhibitors, zinc dialkyldithiophosphates, VI improvers, pour point depressants, antioxidants, and friction modifiers.

13. The composition of claim 1 further comprising at least one member selected from the group consisting of zinc dialkyldithiophosphates, zinc diaryldithiophosphates, and mixtures thereof.

14. The composition of claim 2 further comprising at least one member selected from the group consisting of zinc dialkyldithiophosphates, zinc diaryldithiophosphates, and mixtures thereof.

* * * * *